US007520720B2

(12) United States Patent
Welch

(10) Patent No.: US 7,520,720 B2
(45) Date of Patent: Apr. 21, 2009

(54) PUMP

(75) Inventor: C. Evan Welch, New Berlin, WI (US)

(73) Assignee: Sta-Rite Industries, LLC, Delavan, WI (US)

( * ) Notice: Subject to any disclaimer, the term of this patent is extended or adjusted under 35 U.S.C. 154(b) by 497 days.

(21) Appl. No.: 10/900,536

(22) Filed: Jul. 28, 2004

(65) Prior Publication Data

US 2006/0024174 A1 Feb. 2, 2006

(51) Int. Cl.
*F04D 29/42* (2006.01)

(52) U.S. Cl. ..... 415/199.1; 415/214.1; 415/201; 415/206; 415/211.2; 415/230; 417/360; 417/423.3; 417/423.14

(58) Field of Classification Search ..... 415/199.1, 415/201, 203, 206, 182.1, 211.2, 174.2, 230; 417/360, 423.15, 423.14, 423.3
See application file for complete search history.

(56) References Cited

U.S. PATENT DOCUMENTS

| | | | | |
|---|---|---|---|---|
| 2,375,085 | A | | 5/1945 | Curtis |
| 3,044,407 | A | | 7/1962 | Perkins et al. |
| 3,064,340 | A | | 11/1962 | Green |
| 3,482,522 | A | | 12/1969 | Baker et al. |
| 3,661,474 | A | | 5/1972 | Sieghartner |
| 3,761,204 | A | | 9/1973 | Pauliukonis |
| 3,949,567 | A | * | 4/1976 | Stech ..... 464/154 |
| 4,067,665 | A | | 1/1978 | Schwartzman |
| 4,116,583 | A | * | 9/1978 | Budris ..... 415/199.1 |
| 4,138,201 | A | * | 2/1979 | Dernedde et al. ..... 415/213.1 |
| 4,621,975 | A | * | 11/1986 | Larson ..... 415/111 |
| 4,923,367 | A | * | 5/1990 | Zimmer ..... 415/199.1 |
| 5,000,845 | A | | 3/1991 | Solomon |
| 5,407,323 | A | | 4/1995 | Gay et al. |
| 5,476,367 | A | | 12/1995 | Zimmermann et al. |
| 5,571,000 | A | | 11/1996 | Zimmermann et al. |
| 5,599,164 | A | | 2/1997 | Murray |
| 6,227,802 | B1 | * | 5/2001 | Torgerson et al. ..... 415/199.2 |
| 6,575,714 | B2 | | 6/2003 | Pace et al. |

* cited by examiner

*Primary Examiner*—Ninh H Nguyen
(74) *Attorney, Agent, or Firm*—Greenberg Traurig, LLP

(57) ABSTRACT

Some embodiments of the present invention provide a pump including a pump housing having an inlet adapted to fluidly couple with an inlet conduit, and an outlet adapted to fluidly couple with an outlet conduit. The pump also includes a pump shaft rotatably supported in the pump housing and a plurality of impellers coupled for rotation with the pump shaft. The pump further includes a motor removably coupled to the pump housing. The motor has an output shaft drivably coupled to the pump shaft. The pump also includes a spacer positioned between the plurality of impellers and the motor. The spacer includes at least one aperture to access and decouple the output shaft and the pump shaft. The motor, spacer, pump shaft, and the plurality of impellers are removable from the pump housing as a single unit without disconnecting the inlet conduit and the outlet conduit from the pump housing.

55 Claims, 7 Drawing Sheets

PUMP

FIELD OF THE INVENTION

This invention relates generally to pumps, and more particularly to readily serviceable pumps.

BACKGROUND OF THE INVENTION

Pumps are typically utilized in various applications to increase the pressure of fluid provided by a fluid source. Conventional pumps can include an inlet to connect to an inlet conduit providing fluid from the fluid source at an initial pressure, and an outlet to connect to an outlet conduit carrying pressurized fluid away from the pump. Servicing conventional pumps typically requires disconnecting the inlet and outlet conduits from the pumps and completely disassembling the pumps to gain access to the pumps' internal components. As a result, the inlet and outlet conduits must be reconnected to the pumps after the pumps are serviced. Such a process often results in extended periods of downtime. Also, having to frequently disconnect and reconnect the inlet and outlet conduits and the pumps can increase the likelihood of leakage between the conduits and the pumps.

SUMMARY OF THE INVENTION

Some embodiments of the present invention provide a pump including a pump housing having an inlet adapted to fluidly couple with an inlet conduit, and an outlet adapted to fluidly couple with an outlet conduit. The pump also includes a pump shaft rotatably supported in the pump housing and a plurality of impellers coupled for rotation with the pump shaft. The plurality of impellers are operable to pressurize a fluid in the pump housing. The pump further includes a motor removably coupled to the pump housing. The motor has an output shaft drivably coupled to the pump shaft. The pump also includes a spacer positioned between the plurality of impellers and the motor. The spacer is coaxial with the output shaft and the pump shaft. The spacer includes at least one aperture located and sized to enable access the output shaft and the pump shaft to de-couple the output shaft and the pump shaft. The motor, spacer, pump shaft, and the plurality of impellers are removable from the pump housing as a single unit without disconnecting the inlet conduit and the outlet conduit from the pump housing.

Other embodiments of the present invention provide a pump including a pump housing having an inlet adapted to fluidly couple with an inlet conduit and an outlet adapted to fluidly couple with an outlet conduit, a pump shaft rotatably supported in the pump housing, and a plurality of impellers coupled for rotation with the pump shaft. The plurality of impellers are operable to pressurize a fluid in the pump housing. The pump also includes a motor coupled to the pump housing. The motor has an output shaft drivably coupled to the pump shaft. The pump further includes a seal cap positioned between the motor and the pump housing to at least partially seal against the pump housing. The seal cap includes an aperture dimensioned to receive one of the output shaft and the pump shaft. The pump also includes a seal assembly having a stationary seal coupled to the seal cap and coaxial with the aperture. The stationary seal has a stationary surface. The seal assembly also has a rotating seal coupled for rotation with the one of the output shaft and the pump shaft. The rotating seal has a rotating surface engageable with the stationary surface. The stationary surface and the rotating surface are axially spaced from an interior surface of the seal cap.

Some embodiments of the present invention provide a method of servicing a pump. The method includes providing a pump housing fixed to a support surface. The pump housing includes an inlet fluidly coupled with an inlet conduit and an outlet fluidly coupled with an outlet conduit. The method also includes providing a pump assembly in the pump housing and a motor drivably coupled to a portion of the pump assembly. The motor is coupled to the pump housing and spaced from a remaining portion of the pump assembly by a spacer. The method further includes de-coupling the motor from the pump housing and removing the motor and the pump assembly from the pump housing as a single unit while the inlet conduit remains fluidly coupled with the pump housing inlet, and the outlet conduit remains fluidly coupled with the pump housing outlet. The method also includes accessing an interface between the motor and the pump assembly through an aperture in the spacer to de-couple the motor and the pump assembly and separating the motor from the pump assembly.

Other embodiments of the present invention provide a pump including a pump housing having an inlet adapted to fluidly couple with an inlet conduit, and an outlet adapted to fluidly couple with an outlet conduit, and a pump assembly operable to pressurize a fluid in the pump housing. The pump assembly includes a pump shaft rotatably supported in the pump housing, at least one impeller coupled for rotation with the pump shaft, at least one suction cap positioned upstream of the at least one impeller, at least one diffuser positioned downstream of the at least one impeller, and a retainer coupled to the pump shaft downstream of the at least one diffuser. The pump also includes a motor removably coupled to the pump housing and having an output shaft drivably coupled to the pump shaft. The motor is removable from the pump housing with the pump assembly as a single unit.

Yet other embodiments of the present invention provide a method of servicing a pump. The method includes providing a pump housing coupled to a support surface. The pump housing includes an inlet fluidly coupled with an inlet conduit, and an outlet fluidly coupled with an outlet conduit. The method also includes providing a pump assembly in the pump housing. The pump assembly includes a pump shaft rotatably supported in the pump housing, at least one impeller coupled for rotation with the pump shaft, at least one suction cap positioned upstream of the at least one impeller, at least one diffuser positioned downstream of the at least one impeller, and a retainer coupled to the pump shaft downstream of the at least one diffuser. The method further includes providing a motor drivably coupled to the pump shaft, de-coupling the motor from the pump housing, and removing the motor and the pump assembly from the pump housing as a single unit.

Other features and aspects of the present invention will become apparent to those skilled in the art upon review of the following detailed description, claims and drawings.

BRIEF DESCRIPTION OF THE DRAWINGS

In the drawings, wherein like reference numerals indicate like parts.

Figure 1:
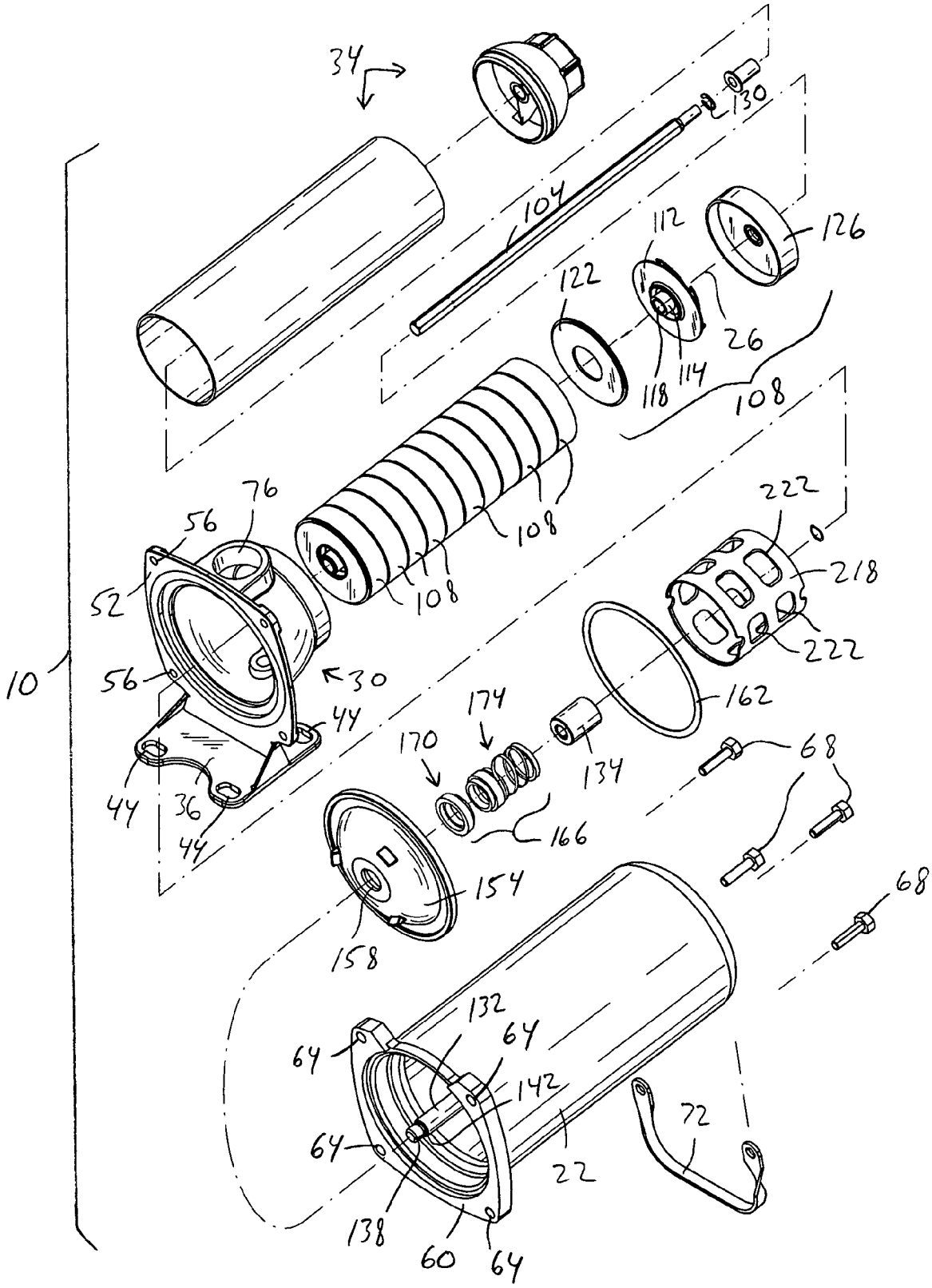
FIG. 1 is an exploded perspective view of a pump of the present invention.

Before any features of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including", "having", and "comprising" and variations thereof herein is meant to encompass the items listed thereafter and equivalents thereof as well as additional items. The use of letters to identify elements of a method or process is simply for identification and is not meant to indicate that the elements should be performed in a particular order.

DETAILED DESCRIPTION

Figure 2:
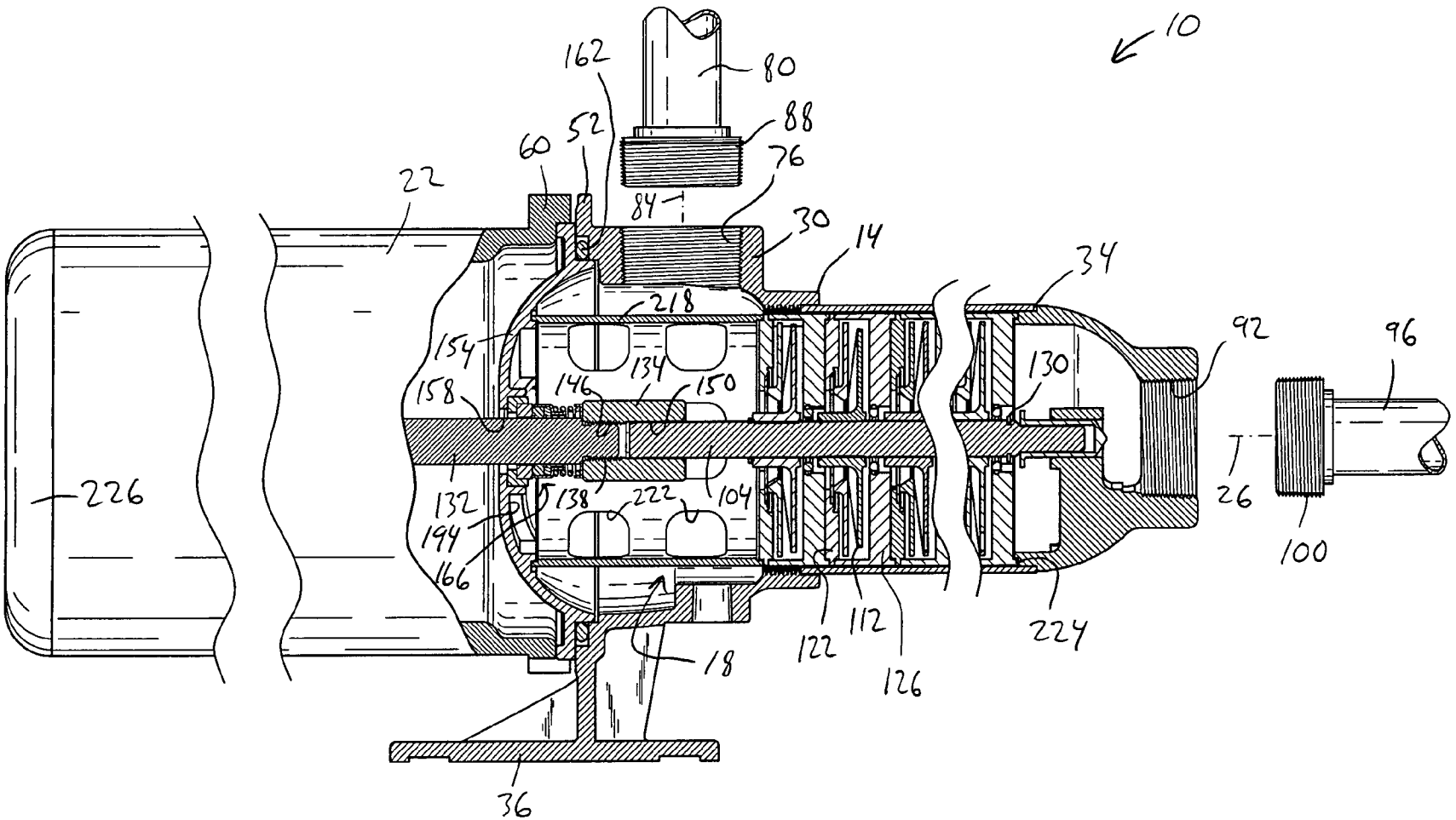
FIG. 2 is an assembled, partial cross-sectional view of the pump of FIG. 1, illustrating an inlet conduit and an outlet conduit fluidly coupled to the pump.
Figure 3:
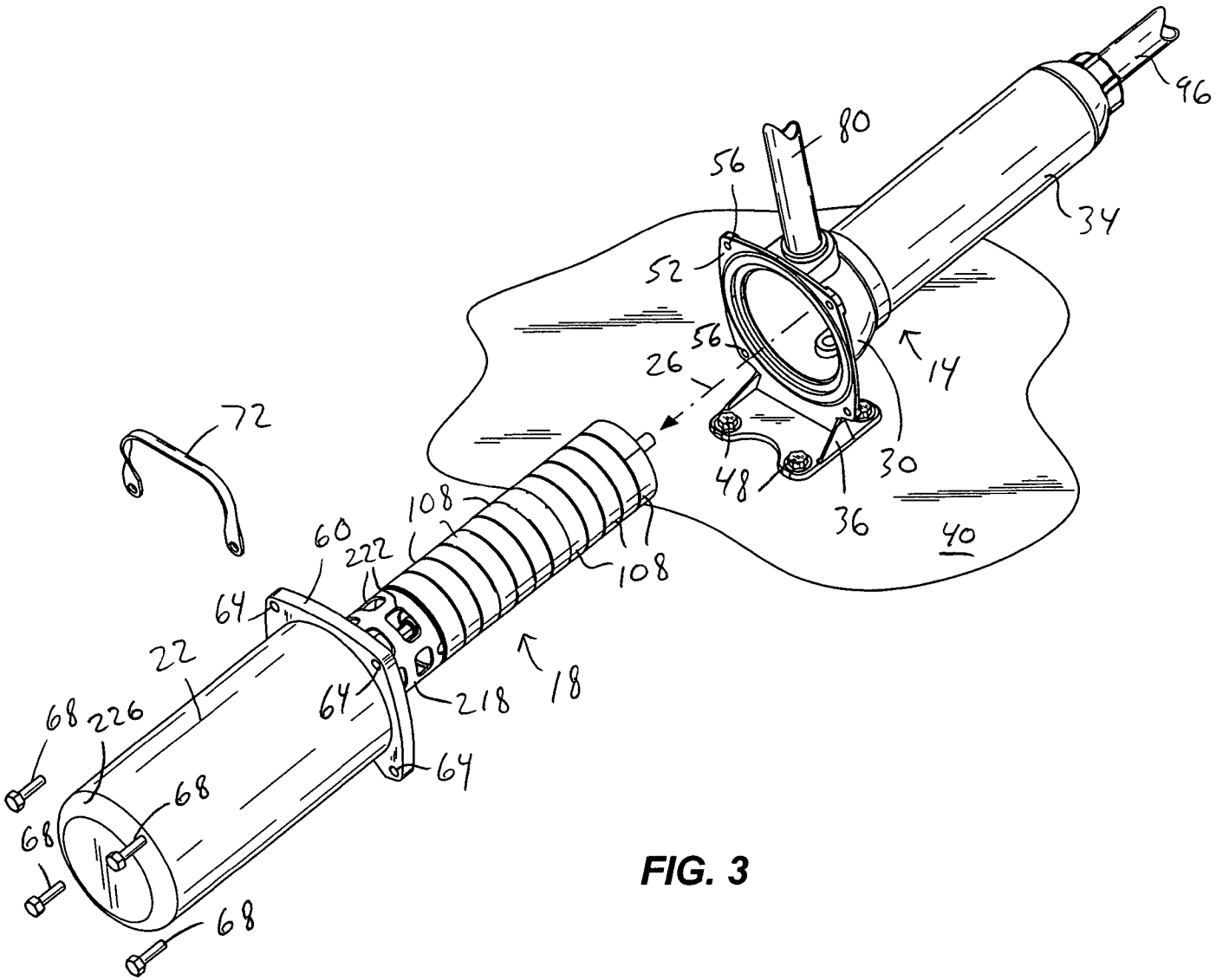
FIG. 3 is a partially-exploded perspective view of the pump of FIG. 1, illustrating a motor and a pump assembly being removed from a pump housing while maintaining the connections of the inlet conduit and the outlet conduit to the pump housing.

FIGS. 1-6*b* illustrate a pump 10 constructed in accordance with some embodiments of the present invention. With reference to FIGS. 1-3, the pump 10 generally includes a pump housing 14, a pump assembly 18 positioned in the pump housing 14, and a motor 22 coupled to the pump housing 14 and drivably coupled to the pump assembly 18 along a central axis 26. As shown in FIG. 3, the pump housing 14 generally includes an inlet portion 30 and an outlet or discharge portion 34. The inlet portion 30 and the discharge portion 34 can be coupled using any of a number of different methods such as, for example, welding or brazing, using a threaded connection, using tie rods, and so forth. If threads or tie rods, for example, are utilized to couple the inlet portion 30 and the discharge portion 34, an O-ring (not shown) or other seal (e.g., a square ring, quad ring, etc.) can be utilized to seal the inlet portion 30 to the discharge portion 34. Alternatively, the discharge portion 34 can be integrally formed with the inlet portion 30, such that the pump housing 14 is a one-piece construction. In the illustrated embodiment, the discharge portion 34 is shown as a two-piece construction that is joined together by a welding process, for example. Alternatively, the discharge portion 34 can be a one-piece construction.

Figure 6A:
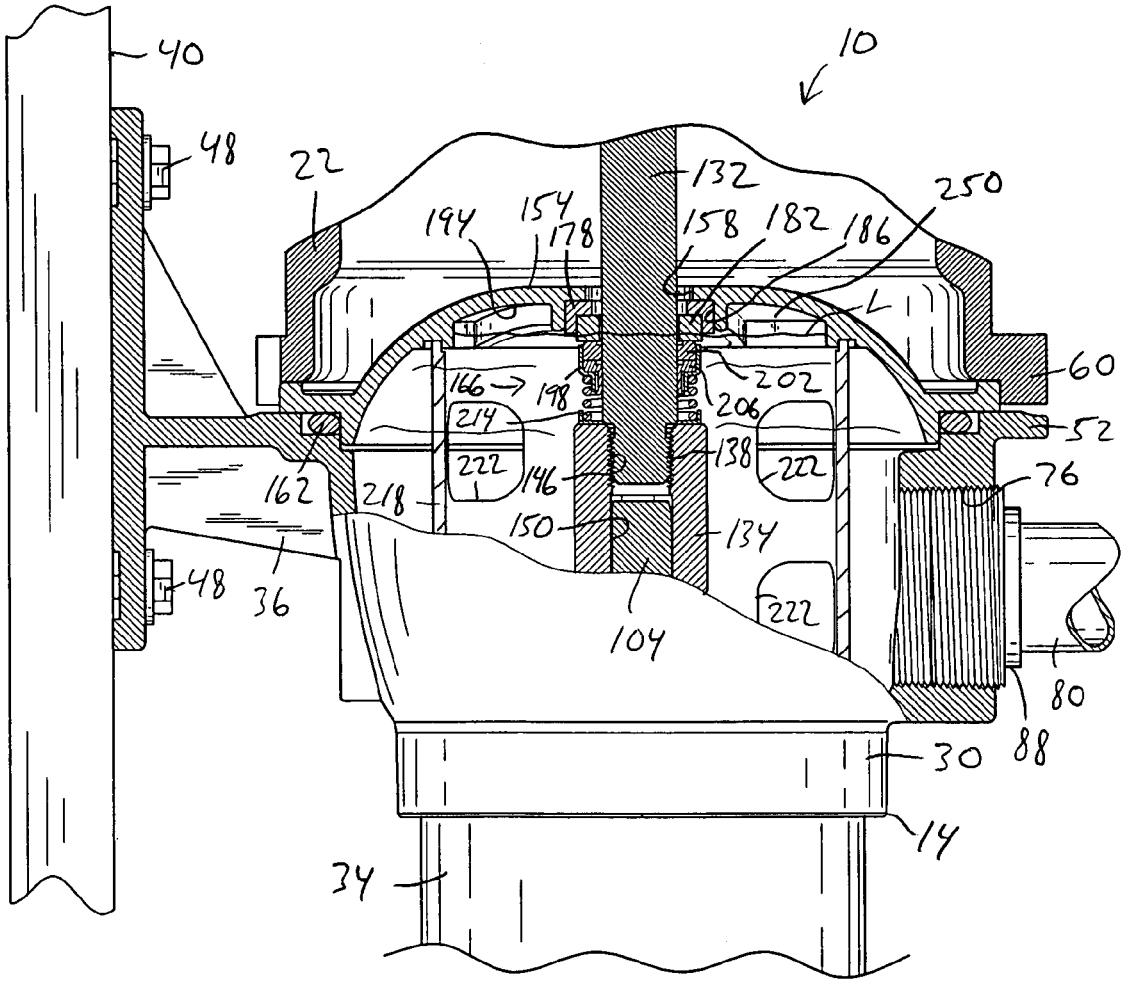
FIG. 6*a* is an enlarged, partial cross-sectional view through the pump of FIG. 1, illustrating a seal plate and a mechanical seal.

The inlet portion 30 includes a base 36 for mounting the pump housing 14 to a support surface 40 (see FIG. 6*a*). The base 36 includes a plurality of apertures 44 through which fasteners 48 (e.g., bolts, screws, etc.) can be passed to mount the pump housing 14 to the support surface 40. Alternatively, the base 36 can include other mounting structure configured to mount to mating mounting structure fixed to the support surface 40.

The inlet portion 30 also includes a flange 52 for mounting the motor 22 to the pump housing 14. In the illustrated embodiment of FIG. 1, the flange 52 incorporates a square bolt pattern including four apertures 56. The motor 22 includes a flange 60 incorporating a plurality of apertures 64 conforming to the same square bolt pattern, such that fasteners 68 (e.g., bolts) can be passed through the respective apertures 64, 56 in the motor flange 60 and the pump housing flange 52 to secure the motor 22 to the pump housing 14. As a result, the motor 22 can be mounted with respect to the pump housing 14 in four different orientations, thereby allowing external electrical connections (not shown) to the motor 22 to be conveniently oriented with respect to the support surface 40.

Alternatively, the flange 60 of the motor 22 and the flange 52 of the pump housing 14 can incorporate a bolt pattern having more or less than four apertures, or other connection techniques can be used. Further, the bolt pattern on the pump housing flange 52 can be arranged to include a multiple of the apertures on the motor flange 60, thereby allowing the motor 22 to be mounted to the pump housing 14 in a multiple of different orientations. In the illustrated embodiment, the apertures 56 in the pump housing flange 52 are threaded to receive the fasteners 68. However, the apertures 64 in the motor flange 60 can alternatively be threaded to receive the fasteners 68. A handle 72 can also be coupled to the motor flange 60 as a convenience when transporting or installing the pump 10.

The inlet portion 30 of the pump housing 14 includes an inlet 76 for fluidly coupling an inlet conduit 80 (see FIG. 2) to the pump housing 14. The inlet conduit 80 can be configured as a pipe, a hose, or any other fluid-carrying body that delivers a fluid (e.g., water) to the inlet portion 30 of the pump housing 14 from a fluid source at an initial pressure. As shown in FIG. 2, the inlet 76 is defined along an axis 84 substantially perpendicular with the central axis 26. The inlet 76 can be threaded to receive a fluid coupling 88 for connecting the inlet conduit 80.

FIG. 1 shows the tubular discharge portion 34 enclosing most of the pump assembly 18. The tubular discharge portion 34 includes an outlet 92 defined along the central axis 26 for fluidly coupling an outlet conduit 96 (see FIG. 2) to the pump housing 14. Like the inlet conduit 80, the outlet conduit 96 can be configured as a pipe, a hose, or any other fluid-carrying body that transports pressurized fluid from the pump 10. Like the inlet 76, the outlet 92 can be threaded to receive a fluid coupling 100 for connecting the outlet conduit 96. The pump assembly 18 pressurizes the fluid as the fluid flows from the inlet 76 to the outlet 92. The outlet conduit 96 then carries the pressurized fluid from the pump housing 14. In alternative embodiments of the invention, the pump assembly 18 can be configured to pressurize the fluid as the fluid flows from the outlet 92 to the inlet 76, effectively reversing the flow through the pump 10.

With reference to FIG. 1, the pump assembly 18 includes a pump shaft 104 and a plurality of hydraulic stages 108 arranged end-to-end along the pump shaft 104. As shown in FIG. 2, the pump shaft 104 is supported for rotation in the pump housing 14. As shown in FIGS. 1 and 2, each hydraulic stage 108 includes an impeller 112 coupled for rotation with the pump shaft 104. In the illustrated embodiment, the pump shaft 104 includes a hexagonal outer shape or surface and the impellers 112 include respective hubs 114 having hexagonal bores 118 to receive the hexagonal pump shaft 104. Alternatively, the impellers 112 can be permanently connected to the pump shaft 104 by methods such as, for example, welding or brazing.

Each hydraulic stage 108 also includes a suction cap 122 upstream of the impeller 112 and a diffuser 126 downstream of the impeller 112. U.S. Pat. No. 5,407,323, incorporated herein by reference in its entirety, includes additional disclosure relating to the suction cap 122, impeller 112, and the diffuser 126. In the illustrated pump assembly 18, twelve hydraulic stages 108 are shown. However, alternative embodiments of the invention can incorporate more or fewer than twelve hydraulic stages 108. Accordingly, alternative embodiments of the invention can include only a single hydraulic stage 108.

Each hydraulic stage 108 is individually operable to pressurize the fluid in the pump housing 14. The pressure of the fluid in the pump housing 14 is incrementally increased due to each subsequent stage 108 as the fluid flows from the inlet 76 to the outlet 92. In each stage 108, the suction cap 122 guides the fluid toward the impeller 112, which accelerates the fluid radially outwardly. The accelerated fluid is then slowed by the diffuser 126, converting a portion of the energy of the accelerated fluid into pressure. The suction cap 122 of an adjacent stage 108 then guides the pressurized fluid into the impeller 112 of the adjacent stage 108 for additional pressurizing.

With reference to FIG. 2, a retainer in the form of a C-clip 130 is coupled to the discharge end of the pump shaft 104 downstream of the hydraulic stages 108. The C-clip 130 prevents the hydraulic stages 108 from sliding off the discharge end of the pump shaft 104. At the inlet end of the pump shaft 104, a portion of the hexagonal-shaped pump shaft 104 (see FIG. 1) is drivably coupled to an output shaft 132 of the motor 22 via an interface or a coupling 134. In some embodiments, the output shaft 132 includes a threaded portion 138 and a shoulder 142 adjacent the threaded portion 138. As shown in FIG. 2, the coupling 134 includes an internally-threaded portion 146 configured to engage the threaded portion 138 of the output shaft 132, and an internal hexagonal-shaped portion 150 configured to receive the hexagonal-shaped pump shaft 104. In the illustrated embodiment, the hexagonal-shaped pump shaft 104 is press-fit into the internal hexagonal-shaped portion 150 of the coupling 134. Accordingly, the coupling 134 is not easily disconnected from the pump shaft 104.

With reference to FIG. 1, a seal cap or a seal plate 154 is positioned between the motor 22 and the pump housing 14 to at least partially seal the pump housing 14. The seal plate 154 includes an aperture 158 to receive the output shaft 132 of the motor 22. In alternative embodiments of the invention, the pump shaft 104 can extend through the aperture 158 in the seal plate 154, and the coupling 134 can be positioned between the motor 22 and the seal plate 154. When the motor 22 is coupled to the pump housing 14, the seal plate 154 is forced against the flange 52 of the pump housing 14. An O-ring 162 can enhance sealing between the seal plate 154 and the flange 52 of the pump housing 14 to substantially prevent leakage between the seal plate 154 and the flange 52 of the pump housing 14. Alternatively, the O-ring 162 can be in the form of a differently configured seal (e.g., a square ring, quad ring, etc.).

Figure 6B:
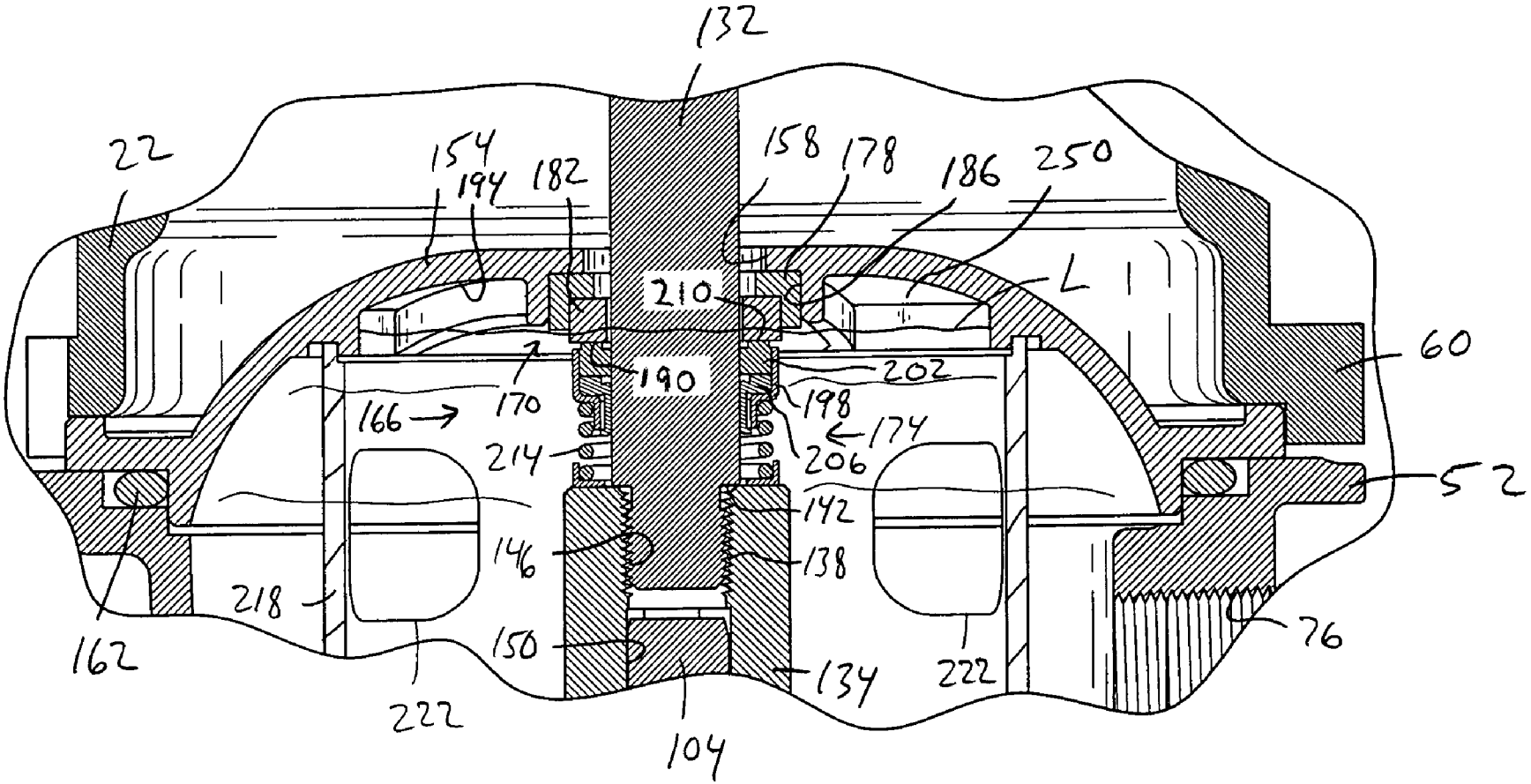
FIG. 6*b* is an enlarged view of the seal plate and mechanical seal of FIG. 6*a*.

As shown in FIGS. 1, 6*a*, and 6*b*, a seal assembly in the form of a mechanical seal 166 is utilized to substantially prevent leakage between the output shaft 132 and the aperture 158 in the seal plate 154. The mechanical seal 166 generally includes a stationary seal 170 fixed to the seal plate 154 and a rotating seal 174 fixed for rotation with the output shaft 132. The stationary seal 170 includes an elastic cup or ring 178 and a ceramic ring 182 extending from the elastic ring 178. In the illustrated embodiment, the elastic ring 178 can be made from rubber or any other elastomer. The elastic ring 178 is sized and configured to be received into a recess 186 formed in the seal plate 154. The elastic ring 178 can be pressed into the recess 186 to provide a seal between the outer periphery of the elastic ring 178 and the inner periphery of the recess 186 as is known in the art. As shown in FIGS. 6*a* and 6*b*, the ceramic ring 182 includes a stationary surface 190 axially spaced from an interior surface 194 of the seal plate 154.

The rotating seal 174 includes a housing 198 having coupled thereto a carbon ring 202 and an elastic shaft seal 206. The carbon ring 202 is concentric with the ceramic ring 182, and includes a rotating surface 210 facing the stationary surface 190 of the stationary seal 170. The elastic shaft seal 206 fits snugly against the output shaft 132 to provide a seal as is known in the art. The rotating seal 174 also includes a compression spring 214 biasing the rotating surface 210 against the stationary surface 190 to provide a seal between the rotating surface 210 and the stationary surface 190 as is known in the art. In the illustrated embodiment, the spring 214 is at least partially compressed between the housing 198 and the coupling 134 to provide the biasing force. As shown in FIG. 2, the coupling 134 is threaded onto the output shaft 132 until the coupling 134 abuts the shoulder 142 of the output shaft 132, which determines the amount that the spring 214 is compressed and establishes the biasing force of the rotating surface 210 against the stationary surface 190. The mechanical seal 166 and the seal plate 154 substantially prevents fluid from leaking out of the pump housing 14.

FIGS. 1 and 2 illustrate a spacer 218 positioned between the seal plate 154 and the hydraulic stages 108. When the pump 10 is assembled, the spacer 218 engages the seal plate 154 at one end and the suction cap 122 of the hydraulic stage 108 disposed closest to the inlet 76. The spacer 218 is positioned to intersect the axis 84 of the inlet 76. The spacer 218 includes a plurality of apertures 222 that allow fluid to flow from the inlet 76 through the spacer 218. In addition to engaging the seal plate 154 when the pump 10 is assembled, the spacer 218 at least partially compresses the suction caps 122 and the diffusers 126 of the respective hydraulic stages 108 against each other, and at least partially compresses the diffuser 126 closest to the outlet 92 against a shoulder 224 inside the tubular discharge portion 34 of the pump housing 14. This prevents significant leakage of fluid between adjacent hydraulic stages 108.

Figure 4A:
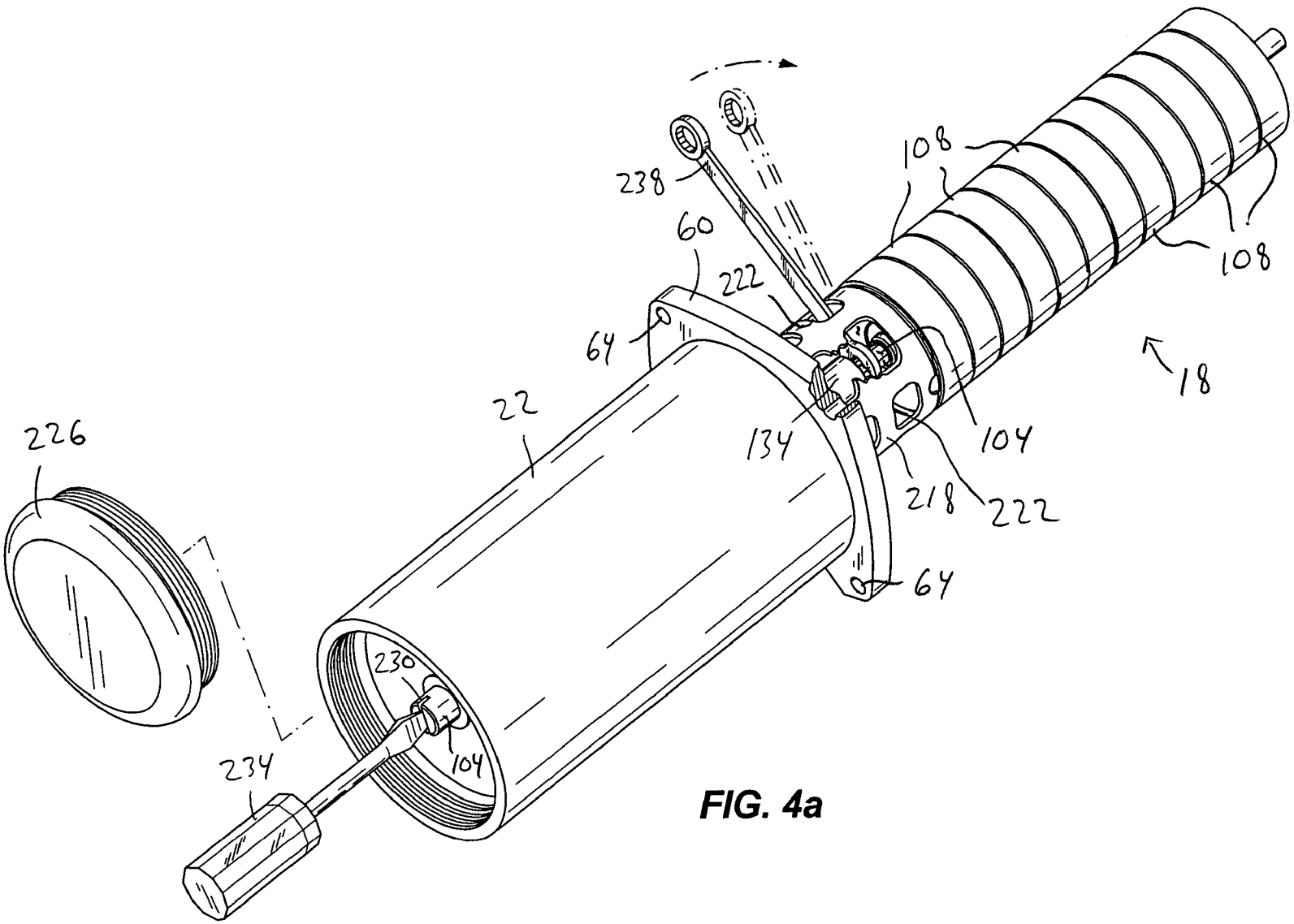
FIG. 4*a* is an enlarged, partially-exploded perspective view of the pump of FIG. 1, illustrating an output shaft of the motor being disconnected from a coupling joining the output shaft to a pump shaft.
Figure 4B:
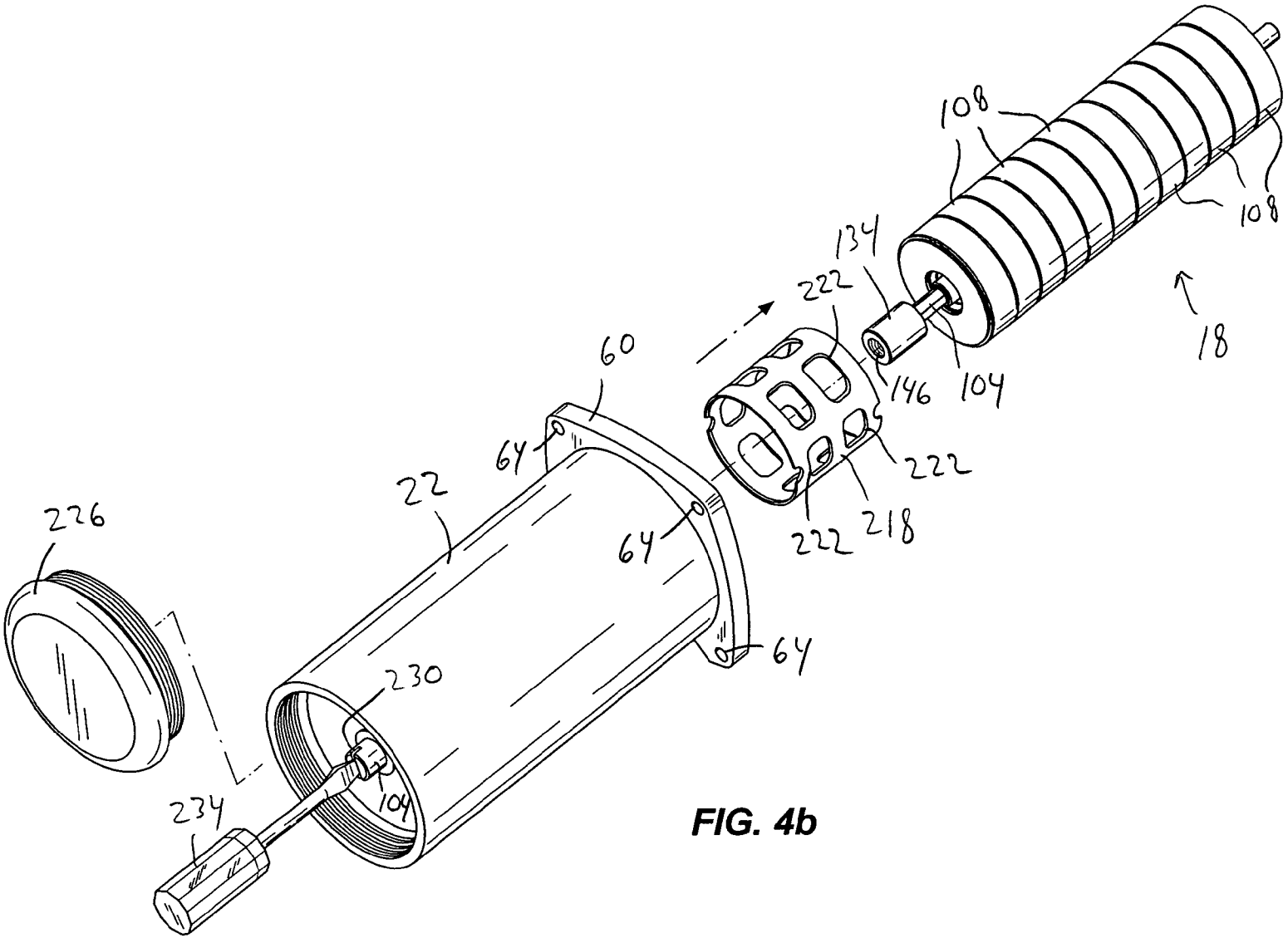
FIG. 4*b* is an enlarged, partially-exploded perspective view of the pump of FIG. 1, illustrating the coupling disconnected from the output shaft.

With reference to FIGS. 3-4*b*, the serviceability of the pump 10 is improved over conventional pumps. More particularly, the installation and removal of the motor 22 and pump assembly 18 with respect to the pump housing 14 is simplified compared to conventional pumps. To remove the pump assembly 18 from the pump housing 14, as shown in FIG. 3, the fasteners 68 are removed from the pump housing 14, and the motor 22 and pump assembly 18 can be pulled out from the pump housing 14 along the central axis 26 as a single unit. The C-clip 130 (or other retention device) on the pump shaft 104 enables the entire stack of hydraulic stages 108 to be pulled out of the pump housing 14 with the pump shaft 104 and the motor 22. As a result, the inlet conduit 80 can remain connected to the inlet 76 of the pump housing 14, and the outlet conduit 96 can remain connected to the outlet 92 of the pump housing 14 during pump servicing.

The coupling 134 can be disengaged from the output shaft 132 to separate the motor 22 from the pump assembly 18. With reference to FIG. 4*a*, an end cap 226 of the motor 22 can be removed to expose the end of the output shaft 132. The end of the output shaft 132 includes a slot 230 that can be engaged by a tool (e.g., a screwdriver 234) to rotationally secure the output shaft 132. Alternatively, other methods of securing the output shaft 132 relative to the housing of the motor 22 can be utilized.

Further, another tool (e.g., an open-end wrench 238) can be inserted through one of the apertures 222 of the spacer 218 to engage the hexagonal-shaped pump shaft 104. The wrench 238 can then incrementally rotate the pump shaft 104, thereby causing the threaded portion 146 of the coupling 134 to disengage the threaded portion 138 of the output shaft 132. Alternatively, the wrench 238 can be used to rotationally secure the pump shaft 104, and the screwdriver 234 can be rotated to rotate the output shaft 132 relative to the coupling 134 to disengage the threaded portion 146 of the coupling 134 from the threaded portion 138 of the output shaft 132. Upon disengaging the coupling 134 and the output shaft 132 (see FIG. 4*b*), the motor 22 can be moved away from the spacer 218 to expose the seal plate 154. Further, rotating seal 174 of the mechanical seal 166 can be removed from the output shaft 132, the seal plate 154 can be disengaged from the motor 22, and the stationary seal 170 of the mechanical seal 166 can be disengaged and removed from the seal plate 154. At this time, the mechanical seal 166, the seal plate 154, and/or the O-ring 162 can be inspected, repaired, and/or replaced.

The coupling 134 can be removed from the pump shaft 104 to remove the hydraulic stages 108 from the pump shaft 104. To remove the coupling 134, the coupling 134 can be pulled from the pump shaft 104, however, sufficient force is required to overcome the resistance of the press fit between the internal hexagonal-shaped portion 150 of the coupling 134 and the hexagonal-shaped pump shaft 104. Any of a number of different tools can be utilized to assist a user with pulling the coupling 134 from the pump shaft 104. Alternatively, the hydraulic stages 108 can be removed from the discharge end of the pump shaft 104 opposite the coupling 134. To accomplish this, the C-clip 130 must be removed from the pump shaft 104.

Once the coupling 134 is disengaged from the pump shaft 104, one or more of the hydraulic stages 108 can be removed from the pump shaft 104 for inspection, repair, or replacement. The installation of the motor 22 and pump assembly 18 into the pump housing 14 is the reverse of the process outlined above.

Figure 5:
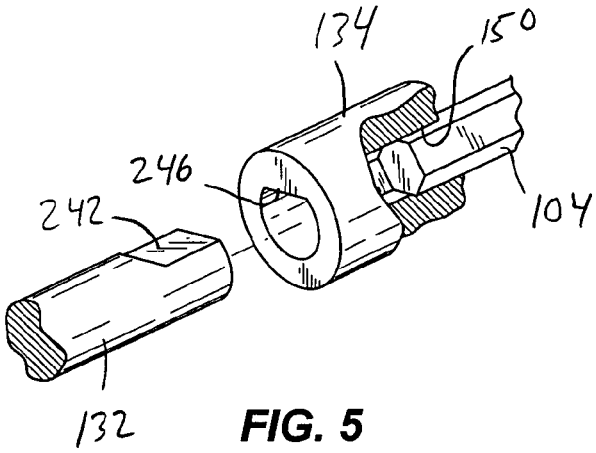
FIG. 5 is an exploded perspective view of an alternative embodiment of the output shaft and the coupling of the pump of FIG. 1.

With reference to FIG. 5, the output shaft 132 and the coupling 134 can utilize a slip-fit connection rather than the threaded connection. For example, the output shaft 132 can include an external flat 242, and the coupling 134 can include an internal flat 246 configured to engage the external flat 242 of the output shaft 132. Alternatively, the output shaft 132 can include a plurality of splines, and the coupling 134 can include a plurality of internal splines configured to engage the splines on the output shaft 132. Such slip-fit connections can allow the motor 22 to be removed from the pump housing 14 separately from the pump assembly 18. As a result, if only the motor 22 required servicing and/or replacement, the pump assembly 18 can be left in the pump housing 14.

With reference to FIGS. 6*a* and 6*b*, the pump 10 is shown mounted in a substantially vertical orientation with fluid in the pump housing 14. The level of the fluid is represented by line L. As shown in FIGS. 6*a* and 6*b*, the interface between the stationary surface 190 and the rotating surface 210 is substantially submerged in the fluid beneath line L. By maintaining both of the stationary and rotating surfaces 190, 210 submerged in the fluid, heat due to friction between the surfaces 190, 210 can be dissipated into the fluid. If the surfaces 190, 210 do not remain substantially submerged in the fluid, the heat due to friction can build up and possibly damage the mechanical seal 166.

During start-up of the pump 10, air trapped in the system typically accumulates toward the top of the seal plate 154. As the trapped air is eventually worked out of the system, the fluid level is allowed to rise above line L. The illustrated seal plate 154 provides sufficient spacing between the stationary surface 190 and the interior top surface 194 of the seal plate 154 to allow accumulation of the trapped air while maintaining the stationary and rotating surfaces 190, 210 substantially submerged in the fluid. Such spacing between the fluid at line L and the interior top surface 194 of the seal plate 154 can define a substantially annular air entrapment chamber 250. Conventional pumps do not provide such an air entrapment chamber, thereby causing the seals of the conventional pumps to often run dry during the start-up period of the conventional pumps.

Various aspects of the present invention are set forth in the following claims.

I claim:

1. A pump comprising:

a pump housing including an inlet adapted to fluidly couple with an inlet conduit, and an outlet adapted to fluidly couple with an outlet conduit;

a pump shaft rotatably supported in the pump housing;

a plurality of impellers coupled for rotation with the pump shaft, the plurality of impellers being operable to pressurize a fluid in the pump housing;

a motor removably coupled to the pump housing and having an output shaft drivably coupled to the pump shaft; and a spacer positioned between the plurality of impellers and the motor and coaxial with the output shaft and the pump shaft, the spacer including at least one aperture located and sized to enable access to the output shaft and the pump shaft to de-couple the output shaft and the pump shaft, allowing the motor, the spacer, the pump shaft, and the plurality of impellers to be removed from the pump housing as a single unit without disconnecting the inlet conduit and the outlet conduit from the pump housing; and a suction cap positioned upstream of each impeller; and a diffuser positioned downstream of each impeller;

wherein the spacer at least partially compresses the suction caps and the diffusers against a portion of the pump housing when the motor is coupled to the pump housing.

2. The pump of claim 1, wherein the pump housing includes a base portion adapted to mount to a support surface.

3. The pump of claim 1, wherein the pump shaft is coaxial with a central axis through the pump housing, wherein the inlet is defined along an axis substantially perpendicular to the central axis, and wherein the outlet is coaxial with the central axis.

4. The pump of claim 1, wherein the pump shaft includes a hexagonal outer surface, and wherein the plurality of impellers include respective hubs having hexagonal bores to receive the pump shaft.

5. The pump of claim 1, wherein a combination of a single suction cap, a single impeller, and a single diffuser comprises a single hydraulic stage.

6. The pump of claim 5, wherein a plurality of hydraulic stages are stacked end-to-end in the pump housing.

7. The pump of claim 1, further comprising a retainer coupled to an end of the pump shaft opposite the motor, the retainer allowing the plurality of diffusers and suction caps to be removed from the pump housing with the pump shaft and the plurality of impellers.

8. The pump of claim 1, wherein the motor is mountable to the pump housing in at least two different orientations.

9. The pump of claim 1, further comprising a coupling joining the output shaft and the pump shaft.

10. The pump of claim 9, wherein a tool is insertable through the aperture in the spacer to disengage the coupling from at least one of the output shaft and the pump shaft.

11. The pump of claim 9, wherein a slip-fit connection is utilized between the coupling and the output shaft.

12. A pump comprising:

a pump housing including an inlet adapted to fluidly couple with an inlet conduit, and an outlet adapted to fluidly couple with an outlet conduit;

a pump shaft rotatably supported in the pump housing;

a plurality of impellers coupled for rotation with the pump shaft, the plurality of impellers being operable to pressurize a fluid in the pump housing;

a motor removably coupled to the pump housing and having an output shaft drivably coupled to the pump shaft; and a spacer positioned between the plurality of impellers and the motor and coaxial with the output shaft and the pump shaft, the spacer including at least one aperture located and sized to enable access to the output shaft and the pump shaft to de-couple the output shaft and the pump shaft, allowing the motor, the spacer, the pump shaft, and the plurality of impellers to be removed from the pump housing as a single unit without disconnecting the inlet conduit and the outlet conduit from the pump housing; and a seal cap positioned between the motor and the pump housing to at least partially seal against the pump housing, the seal cap including an aperture to receive therethrough one of the output shaft and the pump shaft;

a seal assembly including a stationary seal coupled to the seal cap and coaxial with the aperture, the stationary seal having a stationary surface; and a rotating seal coupled for rotation with the one of the output shaft and the pump shaft, the rotating seal having a rotating surface engageable with the stationary surface, wherein the stationary surface and the rotating surface are axially spaced from an interior surface of the seal cap.

13. The pump of claim 12, wherein the seal comprises a mechanical seal including a stationary seal and a rotating seal engageable with the stationary seal, and wherein the stationary seal and the rotating seal are axially spaced from the interior surface of the seal cap.

14. The pump of claim 13, wherein the stationary seal and the rotating seal are at least partially submerged in the fluid in the pump housing during operation of the pump, and wherein an air entrapment chamber is defined between the interior surface of the seal cap and the fluid when the pump is substantially vertically oriented.

15. The pump of claim 12, wherein the seal cap is positioned between the motor and the spacer.

16. The pump of claim 12, further comprising a seal positioned between the seal cap and the pump housing to substantially prevent leakage between the seal cap and the pump housing.

17. A pump comprising:

a pump housing including an inlet adapted to fluidly couple with an inlet conduit, and an outlet adapted to fluidly couple with an outlet conduit;

a pump shaft rotatably supported in the pump housing;

a plurality of impellers coupled for rotation with the pump shaft, the plurality of impellers being operable to pressurize a fluid in the pump housing;

a motor removably coupled to the pump housing and having an output shaft drivably coupled to the pump shaft; and a spacer positioned between the plurality of impellers and the motor and coaxial with the output shaft and the pump shaft, the spacer including at least one aperture located and sized to enable access to the output shaft and the pump shaft to dc-couple the output shaft and the pump shaft, allowing the motor, the spacer, the pump shaft, and the plurality of impellers to be removed from the pump housing as a single unit without disconnecting the inlet conduit and the outlet conduit from the pump housing;

wherein the motor includes a flange having a bolt pattern, and wherein the pump housing includes a flange having at least one corresponding bolt pattern defined thereon.

18. A pump comprising:

a pump housing including an inlet adapted to fluidly couple with an inlet conduit, and an outlet adapted to fluidly couple with an outlet conduit;

a pump shaft rotatably supported in the pump housing;

a plurality of impellers coupled for rotation with the pump shaft, the plurality of impellers being operable to pressurize a fluid in the pump housing;

a motor removably coupled to the pump housing and having an output shaft drivably coupled to the pump shaft; and a spacer positioned between the plurality of impellers and the motor and coaxial with the output shaft and the pump shaft, the spacer including at least one aperture located and sized to enable access to the output shaft and the pump shaft to de-couple the output shaft and the pump shaft, allowing the motor, the spacer, the pump shaft, and the plurality of impellers to be removed from the pump housing as a single unit without disconnecting the inlet conduit and the outlet conduit from the pump housing;

wherein the motor includes a flange having a first square bolt pattern, and wherein the pump housing includes a flange having a second square bolt pattern substantially identical to the first square bolt pattern.

19. A pump comprising:

a pump housing including an inlet adapted to fluidly couple with an inlet conduit, and an outlet adapted to fluidly couple with an outlet conduit;

a pump shaft rotatably supported in the pump housing;

a plurality of impellers coupled for rotation with the pump shaft, the plurality of impellers being operable to pressurize a fluid in the pump housing;

a motor removably coupled to the pump housing and having an output shaft drivably coupled to the pump shaft; and a spacer positioned between the plurality of impellers and the motor and coaxial with the output shaft and the pump shaft, the spacer including at least one aperture located and sized to enable access to the output shaft and the pump shaft to de-couple the output shaft and the pump shaft, allowing the motor, the spacer, the pump shaft, and the plurality of impellers to be removed from the pump housing as a single unit without disconnecting the inlet conduit and the outlet conduit from the pump housing; and a seal cap positioned between the motor and the pump housing to at least partially seal against the pump housing;

a plurality of suction caps corresponding with the plurality of impellers, each suction cap being positioned upstream of the respective impeller, wherein one end of the spacer engages the seal cap, and wherein an opposite end of the spacer engages one of the plurality of suction caps.

20. A pump comprising:

a pump housing including an inlet adapted to fluidly couple with an inlet conduit, and an outlet adapted to fluidly couple with an outlet conduit;

a pump shaft rotatably supported in the pump housing;

a plurality of impellers coupled for rotation with the pump shaft, the plurality of impellers being operable to pressurize a fluid in the pump housing;

a motor coupled to the pump housing, the motor having an output shaft drivably coupled to the pump shaft;

a seal cap positioned between the motor and the pump housing to at least partially seal against the pump housing, the seal cap including an aperture dimensioned to receive one of the output shaft and the pump shaft; and a seal assembly including a stationary seal coupled to the seal cap and coaxial with the aperture, the stationary seal having a stationary surface; and a rotating seal coupled for rotation with the one of the output shaft and the pump shaft, the rotating seat having a rotating surface engageable with the stationary surface, wherein the stationary surface and the rotating surface are axially spaced from an interior surface of the seal cap; and a spacer positioned between the seal cap and the plurality of impellers and coaxial with the output shaft and the pump shaft, the spacer including at least one aperture therethrough to access the motor shaft and the pump shaft to de-couple the motor shaft and the pump shaft.

21. The pump of claim 20, wherein the pump housing includes a base portion adapted to mount to a support surface.

22. The pump of claim 20, wherein the pump shaft is coaxial with a central axis through the pump housing, wherein the inlet is defined along an axis substantially perpendicular to the central axis, and wherein the outlet is coaxial with the central axis.

23. The pump of claim 20, wherein the pump shaft includes a hexagonal outer surface, and wherein the plurality of impellers include respective hubs having hexagonal bores to receive the pump shaft.

24. The pump of claim 23, further comprising a coupling joining the output shaft and the pump shaft.

25. The pump of claim 20, further comprising a seal positioned between the seal cap and the pump housing to substantially prevent leakage between the seal cap and the pump housing.

26. The pump of claim 20, further comprising: a suction cap positioned upstream of each impeller; and a diffuser positioned downstream of each impeller.

27. The pump of claim 26, wherein a combination of a single suction cap, a single impeller, and a single diffuser comprises a single hydraulic stage.

28. The pump of claim 27, wherein a plurality of hydraulic stages are stacked end-to-end in the pump housing.

29. The pump of claim 26, further comprising a retainer coupled to an end of the pump shaft opposite the motor, the retainer allowing the plurality of diffusers and suction caps to be removed from the pump housing with the pump shaft and the plurality of impellers.

30. The pump of claim 20, wherein the motor includes a flange having a bolt pattern, and wherein the pump housing includes a flange having at least one of the bolt patterns defined thereon.

31. The pump of claim 20, wherein the motor includes a flange having a first square bolt pattern, and wherein the pump housing includes a flange having a second square bolt pattern substantially identical to the first square bolt pattern.

32. The pump of claim 20, wherein the motor is mountable to the pump housing in at least two different orientations.

33. The pump of claim 20, wherein a slip-fit connection is utilized between the output shaft and the pump shaft.

34. The pump of claim 20, wherein the seal assembly comprises a mechanical seal, and wherein the rotating surface is biased into engagement with the stationary surface by a compression spring.

35. A pump comprising:

a pump housing including an inlet adapted to fluidly couple with an inlet conduit, and an outlet adapted to fluidly couple with an outlet conduit;

a pump shaft rotatably supported in the pump housing;

a plurality of impellers coupled for rotation with the pump shaft, the plurality of impellers being operable to pressurize a fluid in the pump housing;

a motor coupled to the pump housing, the motor having an output shaft drivably coupled to the pump shaft;

a seal cap positioned between the motor and the pump housing to at least partially seal against the pump housing, the seal cap including an aperture dimensioned to receive one of the output shaft and the pump shaft;

a seal assembly including a stationary seal coupled to the seal cap and coaxial with the aperture, the stationary seal having a stationary surface;

a rotating seal coupled for rotation with the one of the output shaft and the pump shaft, the rotating seal having a rotating surface engageable with the stationary surface, wherein the stationary surface and the rotating surface are axially spaced from an interior surface of the seal cap, wherein the pump shaft includes a hexagonal outer surface, and wherein the plurality of impellers include respective hubs having hexagonal bores to receive the pump shaft; and a coupling joining the output shaft and the pump shaft;

wherein a tool is insertable through an aperture in a spacer to disengage the coupling from at least one of the output shaft and the pump shaft.

36. A pump comprising:

a pump housing including an inlet adapted to fluidly couple with an inlet conduit, and an outlet adapted to fluidly couple with an outlet conduit;

a pump shaft rotatably supported in the pump housing;

a plurality of impellers coupled for rotation with the pump shaft, the plurality of impellers being operable to pressurize a fluid in the pump housing;

a motor coupled to the pump housing, the motor having an output shaft drivably coupled to the pump shaft;

a seal cap positioned between the motor and the pump housing to at least partially seal against the pump housing, the seal cap including an aperture dimensioned to receive one of the output shaft and the pump shaft; and a seal assembly including a stationary seal coupled to the seal cap and coaxial with the aperture, the stationary seal having a stationary surface;

a rotating seal coupled for rotation with the one of the output shaft and the pump shaft, the rotating seal having a rotating surface engageable with the stationary surface, wherein the stationary surface and the rotating surface are axially spaced from an interior surface of the seal cap;

a suction cap positioned upstream of each impeller;

a diffuser positioned downstream of each impeller; and a spacer positioned between the seal cap and one of the suction caps, wherein the spacer at least partially compresses the suction caps and the diffusers against a portion of the pump housing when the motor is coupled to the pump housing.

37. A pump comprising:

a pump housing including an inlet adapted to fluidly couple with an inlet conduit, and an outlet adapted to fluidly couple with an outlet conduit;

a pump shaft rotatably supported in the pump housing;

a plurality of impellers coupled for rotation with the pump shaft, the plurality of impellers being operable to pressurize a fluid in the pump housing;

a motor coupled to the pump housing, the motor having an output shaft drivably coupled to the pump shaft;

a seal cap positioned between the motor and the pump housing to at least partially seal against the pump housing, the seal cap including an aperture dimensioned to receive one of the output shaft and the pump shaft; and a seal assembly including a stationary seal coupled to the seal cap and coaxial with the aperture, the stationary seal having a stationary surface; and a rotating seal coupled for rotation with the one of the output shaft and the pump shaft, the rotating seal having a rotating surface engageable with the stationary surface, wherein the stationary surface and the rotating surface are axially spaced from an interior surface of the seal cap;

wherein the motor is coupled to the pump housing by at least one fastener such that the motor, the pump shaft, and the plurality of impellers are removable from the pump housing upon removing the fastener without disconnecting the inlet conduit and the outlet conduit from the pump housing.

38. A pump comprising:

a pump housing including an inlet adapted to fluidly couple with an inlet conduit, and an outlet adapted to fluidly couple with an outlet conduit;

a pump shaft rotatably supported in the pump housing;

a plurality of impellers coupled for rotation with the pump shaft, the plurality of impellers being operable to pressurize a fluid in the pump housing;

a motor coupled to the pump housing, the motor having an output shaft drivably coupled to the pump shaft;

a seal cap positioned between the motor and the pump housing to at least partially seal against the pump housing, the seal cap including an aperture dimensioned to receive one of the output shaft and the pump shaft; and a seal assembly including a stationary seal coupled to the seal cap and coaxial with the aperture, the stationary seal having a stationary surface; and a rotating seal coupled for rotation with the one of the output shaft and the pump shaft, the rotating seal having a rotating surface engageable with the stationary surface, wherein the stationary surface and the rotating surface are axially spaced from an interior surface of the seal cap;

wherein the stationary surface and the rotating surface are at least partially submerged in the fluid in the pump housing during operation of the pump, and wherein an air entrapment chamber is defined between the interior surface of the seal cap and the fluid when the pump is substantially vertically oriented.

39. A pump comprising:

a pump housing including an inlet adapted to fluidly couple with an inlet conduit, and an outlet adapted to fluidly couple with an outlet conduit;

a pump assembly operable to pressurize a fluid in the pump housing, the pump assembly including a pump shaft rotatably supported in the pump housing; at least one impeller coupled for rotation with the pump shaft;

at least one suction cap positioned upstream of the at least one impeller; at least one diffuser positioned downstream of the at least one impeller;

a retainer coupled to the pump shaft downstream of the at least one diffuser;

a motor removably coupled to the pump housing and having an output shaft drivably coupled to the pump shaft, the motor being removable from the pump housing with the pump assembly as a single unit; and a spacer positioned between the at least one suction cap and the motor and that is coaxial with the output shaft and the pump shaft, the spacer including at least one aperture therethrough to access the output shaft and the pump shaft to de-couple the output shaft and the pump shaft;

wherein the spacer at least partially compresses the at least one suction cap and the at least one diffuser against a portion of the pump housing when the motor is coupled to the pump housing.

40. The pump of claim 39, wherein the pump housing includes a base portion adapted to mount to a support surface.

41. The pump of claim 39, wherein the pump shaft is coaxial with a central axis through the pump housing, wherein the inlet is defined along an axis substantially perpendicular to the central axis, and wherein the outlet is coaxial with the central axis.

42. The pump of claim 39, wherein the pump shaft includes a hexagonal outer surface, and wherein the at least one impeller includes a hub having a hexagonal bore to receive the pump shaft, 43. The pump of claim 39, wherein a combination of a single suction cap, a single impeller, and a single diffuser comprises a single hydraulic stage.

44. The pump of claim 43, wherein a plurality of hydraulic stages are stacked end-to-end in the pump housing.

45. The pump of claim 39, further comprising: a seal cap positioned between the motor and the pump housing to at least partially seal against the pump housing, the seal cap including an aperture to receive therethrough one of the output shaft and the pump shaft; and a seal assembly including a stationary seal coupled to the seal cap and coaxial with the aperture, the stationary seal having a stationary surface; and a rotating seal coupled for rotation with the one of the output shaft and the pump shaft, the rotating seal having a rotating surface engageable with the stationary surface, wherein the stationary surface and the rotating surface are axially spaced from an interior surface of the seal cap.

46. The pump of claim 45, wherein the seal comprises a mechanical seal including a stationary seal and a rotating seal engageable with the stationary seal, and wherein the stationary seal and the rotating seal are axially spaced from the interior surface of the seal cap.

47. The pump of claim 46, wherein the stationary seal and the rotating seal are at least partially submerged in the fluid in the pump housing during operation of the pump, and wherein an air entrapment chamber is defined between the interior surface of the seal cap and the fluid when the pump is substantially vertically oriented.

48. The pump of claim 45, further comprising a seal positioned between the seal cap and the pump housing to substantially prevent leakage between the seal cap and the pump housing.

49. The pump of claim 39, wherein the motor includes a flange having a bolt pattern, and wherein the pump housing includes a flange having at least one corresponding bolt pattern defined thereon.

50. The pump of claim 39, wherein the motor includes a flange having a first square bolt pattern, and wherein the pump housing includes a flange having a second square bolt pattern substantially identical to the first square bolt pattern.

51. The pump of claim 39, wherein the motor is mountable to the pump housing in at least two different orientations.

52. The pump of claim 39, further comprising a coupling joining the output shaft and the pump shaft.

53. The pump of claim 52, wherein a threaded connection is utilized between the coupling and the output shaft.

54. The pump of claim 52, wherein a slip-fit connection is utilized between the coupling and the output shaft.

55. A pump comprising:

a pump housing including an inlet adapted to fluidly couple with an inlet conduit, and an outlet adapted to fluidly couple with an outlet conduit;

a pump assembly operable to pressurize a fluid in the pump housing, the pump assembly including a pump shaft rotatably supported in the pump housing; at least one impeller coupled for rotation with the pump shaft;

at least one suction cap positioned upstream of the at least one impeller; at least one diffuser positioned downstream of the at least one impeller;

a retainer coupled to the pump shaft downstream of the at least one diffuser;

a motor removably coupled to the pump housing and having an output shaft drivably coupled to the pump shaft, the motor being removable from the pump housing with the pump assembly as a single unit;

a seal cap positioned between the motor and the pump housing to at least partially seal against the pump housing; and a spacer positioned between the seal cap and the at least one suction cap, wherein one end of the spacer engages the seal cap, and wherein an opposite end of the spacer engages the at least one suction cap.

* * * * *